US006273018B1

(12) United States Patent
Gottsche et al.

(10) Patent No.: US 6,273,018 B1
(45) Date of Patent: Aug. 14, 2001

(54) BUOYANT SUBSTRUCTURE FOR OFFSHORE PLATFORM

(76) Inventors: Graham Frederick Gottsche, 6 Holland Park, London Wll 3TG; Poul-Eric Christiansen, 55 Beechwood Road, Sanderstead Surrey CR2 OAE, both of (GB); Earl J. Piermattei, 14B, 25 Victoria Avenue, Claremont Western Australia (AU), 6010

( * ) Notice: Subject to any disclaimer, the term of this patent is extended or adjusted under 35 U.S.C. 154(b) by 0 days.

(21) Appl. No.: 09/319,083

(22) PCT Filed: Aug. 20, 1998

(86) PCT No.: PCT/GB98/02501

§ 371 Date: Jul. 29, 2000

§ 102(e) Date: Jul. 29, 2000

(87) PCT Pub. No.: WO99/10230

PCT Pub. Date: Mar. 4, 1999

(30) Foreign Application Priority Data

Aug. 22, 1997 (GB) ..... 9717831
Jun. 5, 1998 (GB) ..... 9812090

(51) Int. Cl.[7] ..... B63B 35/44
(52) U.S. Cl. ..... 114/264; 114/293
(58) Field of Search ..... 114/264, 265, 114/293

(56) References Cited

U.S. PATENT DOCUMENTS 3,347,052 * 10/1967 Steitle et al. ..... 114/265
3,859,804 * 1/1975 Koehler et al. ..... 114/265

* cited by examiner

*Primary Examiner*—Jesus D. Sotelo
(74) *Attorney, Agent, or Firm*—David M. Ostfeld

(57) ABSTRACT

A buoyant substructure to float upright in water (e.g. for an offshore platform) and comprising at least three spaced apart columns [103] joined together in generally aligned relationship, in which at least one of the columns is adapted to be ballasted at its end [107] which is to float low down in the water, in which the columns are joined together by discrete cross members [111,113] which are widely spaced apart along the length of the columns, and in which the discrete cross members [111,113] have relatively small dimensions in the direction of alignment of the columns as compared with the total length of the columns.

21 Claims, 8 Drawing Sheets

BUOYANT SUBSTRUCTURE FOR OFFSHORE PLATFORM

TECHNICAL FIELD OF THE INVENTION

The invention relates to a buoyant substructure for an offshore platform, and to a method of forming that substructure.

More particularly the invention relates to a buoyant substructure which can be arranged to float upright over an offshore oil and/or gas field, in order to support drilling and/or production facilities.

BACKGROUND OF THE INVENTION

Oil and/or gas production in deep water may be carried out from facilities set on buoyant substructures. These substructures may comprise ship shaped Floating Production Storage and Offloading vessels (FPSO's), semisubmersibles, Tension Leg Platforms (TLP's) or spars. When using FPSO's or semisubmersibles for production, wellheads are usually located on the seabed. For both TLP's and spars, wellheads can be disposed above sea level.

The use of spars for drilling and production is a relatively recent development. (The Brent spar was merely for storage and offloading.) The Oryx Neptune spar (for production) was installed in August 1996. The design, fabrication and installation of that spar were described in OTC Papers 8384 and 8385. These papers were presented at the Offshore Technology Conference in Houston Tex. during May 1997. Subsequently, spars were designed for the Chevron Genesis (drilling and production) and Exxon Diana developments.

The spars referred to above were constructed primarily of steel. It has also been suggested that spars should be made of concrete. Spar configurations for construction in concrete were described on pages 29—33 of Offshore Engineer for April 1996.

In addition to the "spar" substructures described above, proposals have been made for other types of floating substructures designed generally on the spar principle.

One such proposal is set out in PCT Patent Specification No WO96/14473. This shows a single cylindrical hull, and a downward extension formed of four vertical legs of reduced diameter. The cylindrical hull is buoyant, and supports a deck. The vertical legs are connected together by diagonal truss members. The substructure is held in place by an array of semi taut mooring lines.

Our UK Patent Specification No 2,147,546A describes a multi column floating substructure. This has four corner columns which support a deck. The columns are buoyant, and are of substantial diameter. At the lower ends of the columns there are downwardly extending legs of reduced diameter. The downwardly extending legs are connected together by diagonal bracing members. The substructure is held in place by a conventional spread of (catenary) anchor chains.

In the substructures illustrated in these two patent specifications, the downwardly extending legs have diagonal truss or bracing members between them. Moreover, in both cases there are sudden transitions of cross section (from the hull or corner columns respectively, to the legs of reduced diameter).

The substructures in the patent specifications referred to above are designed to be built in a horizontal attitude. The truss or bracing members require significant fabrication activity. Fit up and welding of these members adds cost and takes up time in the fabrication schedule. When complete, the substructures can be floated out (still in a horizontal attitude) to their required locations. At those locations they have to be upended. The sudden transitions of cross section may create instability during floatout and upending.

Multi leg substructures have smaller diameter columns, and so need less reinforcement to resist hydrostatic crushing loads, than do the hulls of spars. This results in lighter substructures to support similar topside weights. Additionally, the spacing apart of the columns gives better stability characteristics.

The present invention is intended to take advantage of these characteristics of a multi leg configuration, while avoiding the need for complex truss or bracing members, extending between the columns. It is also intended to reduce the disadvantages of discontinuities in cross section in the columns.

DISCLOSURE OF THE INVENTION

The invention provides a buoyant substructure to float upright in water (e.g. for an offshore platform) and comprising at least three spaced apart columns joined together in generally aligned relationship, in which at least one of the columns is adapted to be ballasted at its end which is to float low down in the water, in which the columns are joined together by discrete cross members which are widely spaced apart along the length of the columns, and in which the discrete cross members have relatively small dimensions in the direction of alignment of the columns as compared with the total length of the columns.

It is preferred that at least the column adapted to be ballasted at its end which is to float low down in the water has at least two cylindrical portions, one of which portions is above and the other of which portions is below at least one of the discrete cross members.

It is also preferred that at least the column adapted to be ballasted at its end which is to float low down in the water has a surface piercing portion, a buoyancy portion, and a ballastable portion, and in which (when floating upright) the horizontal cross section of the buoyancy portion is greater than the horizontal cross section of the ballastable portion.

It is further preferred that all of the at least three columns have generally aligned surface piercing portions, buoyancy portions and ballastable portions.

It is further preferred that all of the columns are of identical external configuration.

It is yet still further preferred that two of the columns have identical respective horizontal cross sections along their aligned lengths.

Preferably the columns are aligned in parallel relationship.

Preferably the at least three columns are joined together in spaced apart relationship at three positions along their aligned lengths.

In a form in which there is a surface piercing portion, a buoyancy portion and a ballastable portion, it is preferred that the horizontal cross section of the buoyancy portion is greater than the horizontal cross section of the surface piercing portion.

In this last mentioned form it is further preferred that the at least three columns are joined together in spaced apart relationship between the surface piercing portions, and at or near the respective opposed ends of the ballastable portions.

The columns may be joined by cross members comprising discrete lattice truss frameworks in planes defined by adjacent elongate members.

Alternatively, the columns may be joined by cross members comprising box girder elements in planes defined by adjacent elongate members.

It is preferred that elements joining the columns together in spaced apart relationship constitute riser and/or conductor guides.

It is also preferred that elements joining the columns together in spaced apart relationship constitute heave suppression baffles.

According to a feature of the invention, a mooring line to keep the substructure on station is connected to the substructure by a bridle having upper and lower elements which can be controlled to adjust the line of action of the force in the mooring line.

The invention also provides a method of forming a buoyant substructure (e.g. for an offshore platform) which includes the steps of constructing at least three columns horizontally for joining in a spaced apart relationship, floating the substructure so formed horizontally on two of those columns, uprighting the substructure by selective ballasting with water, adding solid ballast to the lower end of at least one of the columns, and securing the substructure in position with mooring lines.

BRIEF DESCRIPTION OF THE DRAWINGS

Three specific embodiments of the invention will now be described by way of example with reference to the accompanying drawings, in which.

DESCRIPTION OF THE SPECIFIC EMBODIMENTS

A first embodiment of the invention will now be described with reference to FIGS. 1 and 2.

A buoyant substructure has three columns extending down its whole length. In common with conventional spar designs, its stability in the installed condition depends on a combination of buoyancy in an upper part of the substructure and solid ballast at the base. The columns have relatively large diameters in the upper part to provide the required buoyancy, but (as shown) may be slightly waisted near the water line, to adjust the waterplane area, and hence the natural heave period. For heavier topside loads, four columns might be required.

Figure 1:
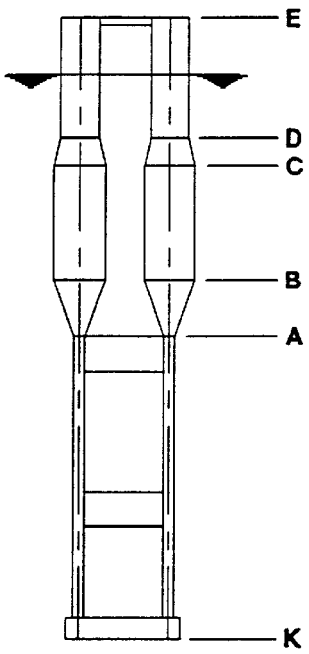
FIG. 1 is a side elevation of a first buoyant substructure forming a first embodiment of the invention.

The geometry of the substructure is shown in FIG. 1. An oblique perspective view of the substructure is shown in FIG. 2. Each column is divided into five portions, which are either cylindrical or conical. Level K is at the base (or Keel) of the substructure. Levels A to D are at peripheral joints between the portions. The water line intersects portion DE. A deck (not shown) is set on Level E. Portion KA is free flooding, and therefore does not need to resist full hydrostatic pressure. The remaining portions have hard tanks, able to sustain the full hydrostatic pressure at the depths at which they operate.

The connections between the columns consist of a plan frame at the base and two sets of plate girders on portion AK. The plan frame at the base is a shallow triangular box, which has guides for the risers, and which contains iron ore ballast. (Alternatively, the iron ore ballast could be enclosed in the columns, but then more ballast would be needed, as it would not be so low down. The triangular box could then be replaced by a stiffened plate which has guides for the risers.) This plan frame also augments the heave added mass and damping. Any additional added mass at the keel increases the heave natural period without incurring any extra wave excitation.

Although riser tension is applied at the top of the well risers, the riser guides at the base K mean that the effective point of application of this lateral load is at the base. The risers are not shielded, so it is not possible to tension them with air cans near the water line. However, deck mounted tensioners give the necessary restraint. Optionally, floatation sleeves (secured to the risers beneath but close to the substructure) can reduce tensioner requirements depending on water depth and presence of submerged currents. This well riser system eliminates the flat vertical walls around the moon pool inside a conventional spar, thereby achieving significant steel weight savings.

Sea water ballast in portions AB and BC is trimming ballast, and might be varied during the running or retrieving of risers, or during the installation of a deck (not shown). The amount of ballast in these portions is at the discretion of the operator. The lower parts of the columns (portion KA) and the plate girders are free flooding.

The permanent ballast compartment is also free flooding and contains iron ore and sea water. Within the plan frame at the base (forming the permanent ballast compartment), part of the volume is occupied by iron ore saturated with sea water, and the remaining space is taken up with sea water alone. If the necessary quantity of iron ore can not fit within this plan frame, increasing the depth or the plan area of that frame will provide more space.

The sizing of the substructure is the first stage of the design cycle, which includes motions response analysis, mooring design, riser design, structural design and detailed weight take off, and engineering for fabrication and installation. The steel weights, vertical mooring loads and riser tensions will all be subject to iterative change as the design progresses.

A spread sheet may be used to perform all kinds of parametric variations. A basic parameter is depth of the draft. A key requirement of the design process is to minimise the heave response by keeping the heave natural period longer than the maximum wave period.

The columns may be waisted around the water line to adjust the waterplane area and hence the heave period. The conical transitions may attract heave excitation, and the efficacy of the design can only be checked following the motions response analysis. Another way in which the heave natural period may be manipulated is by using plated in plan frames between the columns, which significantly augment the heave added mass.

Design iteration may be used to vary the draft against constraints on stability and heave period. Satisfying these two constraints simultaneously requires an iterative approach. Significant parameters are the structural steel weight and the quantity of solid ballast. Given the costs per tonne of these quantities, a draft for minimum cost may be found. However, a substructure design which was optimum on this basis could turn out to have unacceptable motion characteristics.

To increase stability (i.e. GM or overturning stiffness), more ballast is needed, and more buoyancy higher up in the substructure is needed to support the extra ballast. In addition, the draft can be increased. The required level of stability is set by the need for manageable inclinations under the action of wind, wave and current during storms. Since these inclinations are evaluated later in the design cycle, iterations are likely to be needed.

The mooring sheaves (fairleaders) may be set at or near the KG or KB so that mooring line loads and pitch motion are minimised. They may be set at 45% of the draft up from the keel. The exact positioning of the fairleaders is a subject for development. There will be a trade-off between minimising inclinations of the substructure and high line tensions. The fairleader position needs to be compatible with the bracing between the columns.

Spoilers for vortex induced vibration are not necessary as the three spaced columns and exposed conductors are expected to disrupt flow conditions.

The substructure is stable in trim and heel. The generous stability minimises the inclinations under the combination of environmental, mooring and riser loads. The pitch and heave modes are outside the range of wave excitation, so the wave excitation on these modes is low. Thus the motion response is good, and the dynamic loads in the mooring lines are low, despite the relatively taut mooring. The steady state wind forces place the highest load upon the mooring system. Steady state current forces are of less concern than first order wave forces. By tuning the mooring system to shift surge natural frequency away from the significant wave frequency, an optimum solution can be obtained. This optimum is achieved by adjusting line size, line pre-tension and line arrangement to find an effective mooring system stiffness.

Figure 3:
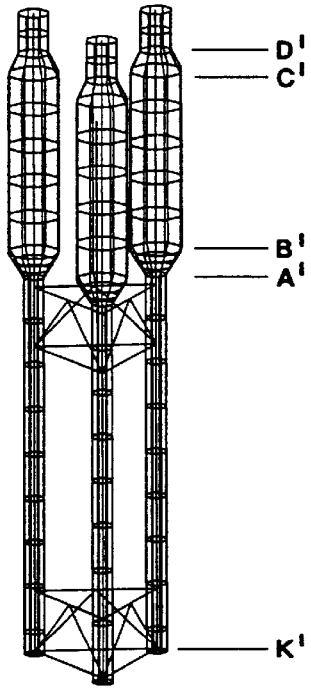
FIG. 3 is a representation of an electronic model of a second buoyant substructure forming a second embodiment of the invention.
Figure 4:
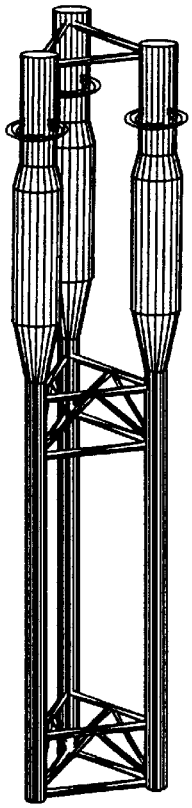
FIG. 4 is a perspective view of the substructure depicted in FIG. 3.

A second embodiment of the invention will now be described with reference to FIGS. 3 and 4.

A buoyant substructure has three columns, and is an assembly of tubular members. The substructure a surface piercing portion (above D'); a submerged buoyancy portion (D' A'); and float out and permanent ballast portion (A' K'). For heavier topside loads four columns might be required.

The surface piercing portion (above D') diameter is selected to achieve a sufficiently long natural period. The submerged buoyancy portion (D'A') diameter and length is selected to support the lightship, deck load, ballast, mooring load vertical reaction and conductor tensioner loads. The lower portion A'K' gives in-service pitch stability.

More specifically, the diameter of the surface piercing portion (above D') is selected to achieve a sufficiently long heave natural period. The submerged buoyancy portion D'A' is selected to minimise vertical force excitation. In addition, a minimum diameter for portion above D' is required to minimise hydroelasticity for drilling operations. The minimum hydroelasticity for well completion drilling is governed by grounding of well riser casings, such that heave response is less than survival stroke of top tensioners. For full drilling capability, the stuck pipe capacity of the drill rig derrick when released will not produce a heave response greater than the survival stroke of the top tensioners.

The three columns consist of cylindrical and conical tubular portions which are interconnected using trusses of tubular members at the base and mid depth, and a plan frame (shown in FIG. 4) at well deck level. A deck (not shown) is rigidly connected to the tops of the columns. The trusses occupy only very limited vertical distances with respect to the total height of the columns.

Figure 2:
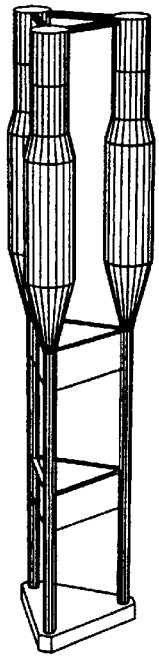
FIG. 2 is an oblique perspective view of that substructure.

Adding box girders (as shown in FIGS. 1 and 2) in place of trusses could reduce heave (in part by added mass). Box girders are useful in reducing surge in spite of their deep sections. This can also be explained by the added inertia effect.

Adding a keel plate increases natural heave period. Added mass and drag of the keel plate supply damping. Keel plates at the other truss girder levels are less effective.

The largest heave excitation component in the critical 4–18 s range is the upper conical portion C'D'. This is closest to the sea surface and hence is subject to the highest water particle velocities. For longer periods, the lower conical portion A'B' imparts a larger force, as it has a greater diameter difference, and the waves take effect deeper in the water. Mooring lines damp both heave and surge.

The rigid well risers extend up from the seabed tie-back to the keel K' of the substructure where they are laterally guided before continuing up to the well deck. The risers are also laterally guided at mid depth within the substructure and at well deck level. Optionally, buoyancy cells are attached to the risers below the keel plan guide until there is sufficient support to develop tension stabilisation. Well tensioners are provided at the well deck level to stabilise the risers from seabed to deck. The BOP is mounted on top of a dry tree on the well deck.

Development of the field begins with construction of wells below the seabed using a Mobile Offshore Drilling Unit (or MODU). The MODU drills a mudline suspended well that will be tied back to the deck facility of the platform using a well completion rig. The well construction programme will be performed in two stages: drilling before platform installation; and drilling after production (from facilities on the platform).

The second stage of the well construction programme may be several years after first oil, depending on the field development plan. Following well construction below seabed, the same MODU (or a DSV) can install suction piles and deploy mooring lines on the seabed prior to installation of the substructure.

Once the substructure arrives on location it is upended and soft moored, and permanent ballast is added to the keel.

The substructure is then ballasted to mating draft. The deck (not shown) is floated over the substructure, and the substructure is deballasted to mate with and lift the deck to operating draft. Chain jacks tighten the mooring lines over a specific well location.

A third embodiment of the invention will now be described in more detail with reference to FIGS. 5 to 27.

Figure 5:
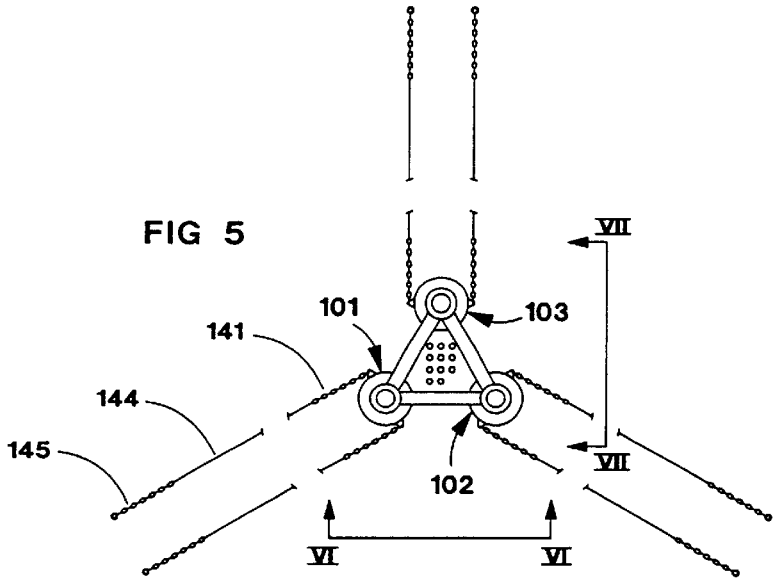
FIG. 5 is a diagrammatic plan of a third embodiment of the invention, showing a three leg, dual line mooring system.
Figure 6:
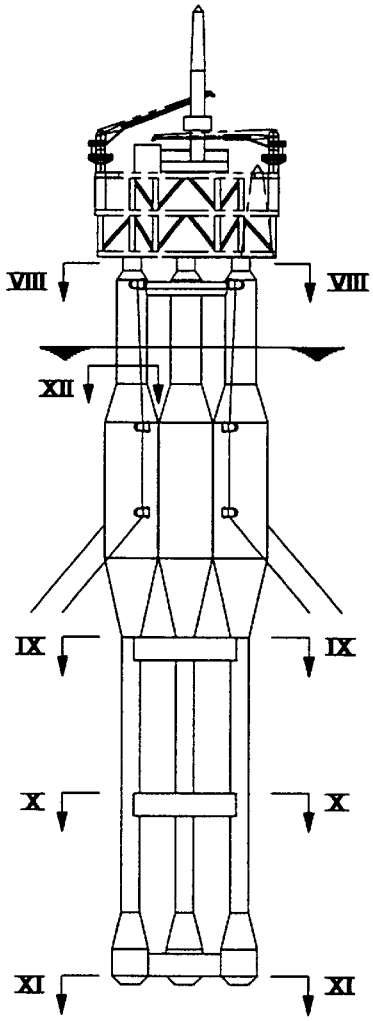
FIG. 6 is a side elevation on line VI—VI in FIG. 5.
Figure 7:
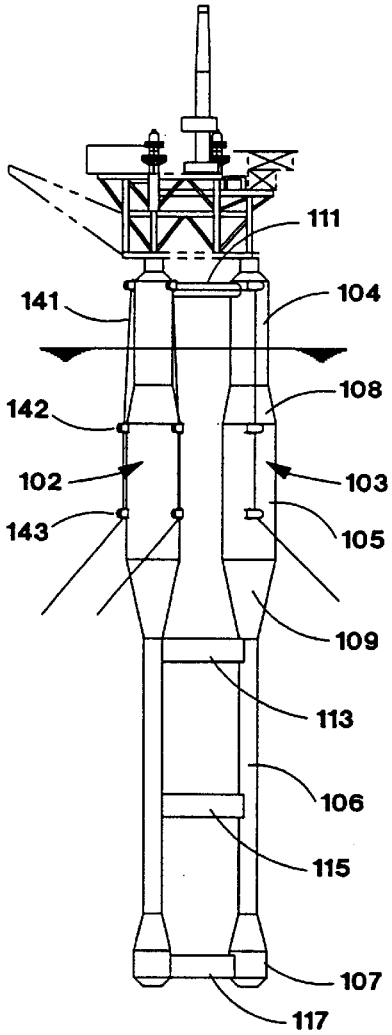
FIG. 7 is a side elevation on line VII—VII in FIG. 5.
Figure 8:
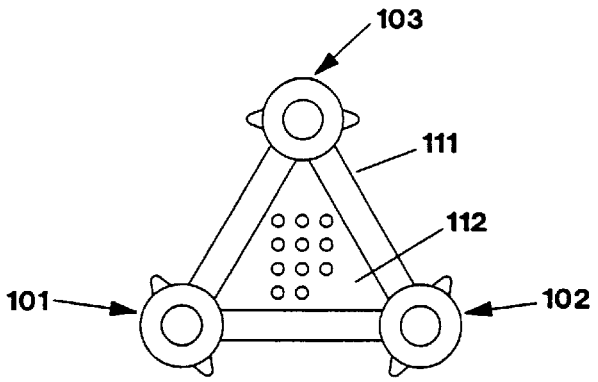
FIG. 8 is a plan on level VIII in FIG. 6 (to an enlarged scale)

FIGS. 5 to 7 show the general arrangement of a substructure for an offshore platform. The substructure has three floatation columns 101, 102 and 103. For some topside configurations, a forth column may be necessary. The columns are arranged in spaced apart side by side relationships, with their axes parallel to each other. The columns are externally identical to each other.

Each column has a surface piercing portion 104, a submerged buoyancy portion 105, and a ballastable portion 106. These portions 104, 105 and 106 are cylindrical. At the foot of the ballastable portion 106 there is a permanent ballast compartment 107. The cylindrical portions 104, 105 and 106 are joined by conical transition portions 108 and 109.

The three columns 101, 102 and 103 are joined at four levels by cross members comprising tubular members and box girders.

Above sea level the columns are joined by horizontal tubular members 111. These tubulars support between them a guide plate 112 (FIG. 8), through which risers can pass up from the seabed to processing facilities on the deck.

Figure 9:
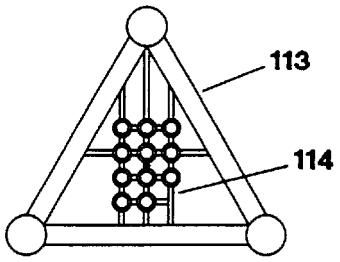
FIG. 9 is a plan on level IX in FIG. 6.

At the tops of the ballastable portions 106 there are box girders 113, supporting guide framing 114 (FIG. 9). The box girders 113 are free flooding, so that the effects of hydrostatic and hydrodynamic pressures can be ignored.

Figure 10:
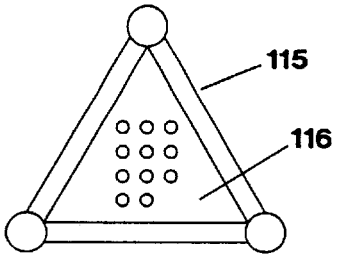
FIG. 10 is a plan on level X in FIG. 6.

Half way down the ballastable portions 106 there are further free flooding box girders 115, supporting another guide plate 116 (FIG. 10).

Figure 11:
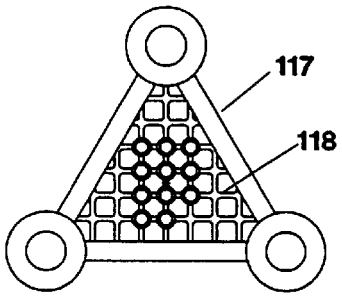
FIG. 11 is a plan on level XI in FIG. 6.

Connecting the permanent ballast compartments 107 there is a third set of box girders 117. Further guide framing 118 is supported by these box girders 117 to form a keel plate (FIG. 11).

The permanent ballast compartments 107 are designed to contain iron ore, and have appropriate flooding and venting valves. Ballast is pumped in from the surface, with the vent valves open. The ballast can be removed by air assisted lift.

It is a feature of the substructure that the flotation columns are spaced apart with members that occupy minimal vertical distance, as compared with the full depth of the columns. Moreover, where the columns are at their widest (at the buoyancy portion 105) the columns are not joined at all.

Figure 12:
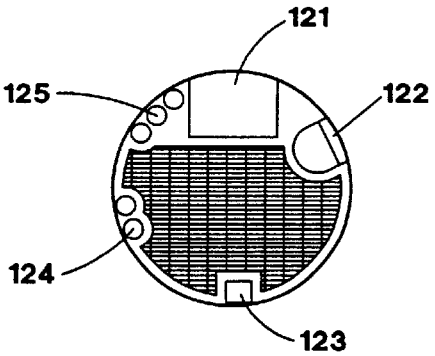
FIG. 12 is a section on line XII in FIG. 6 (to a greatly enlarged scale)

Details of the interior of an upper part of column 101 are shown in FIG. 12. The column encloses a lift 121, a ladder space 122, ventilation ducting 123, chain locker pipes 124 and mechanical systems ducting 125. The upper part of the column is not designed to withstand high hydrostatic pressure.

Figure 13A:
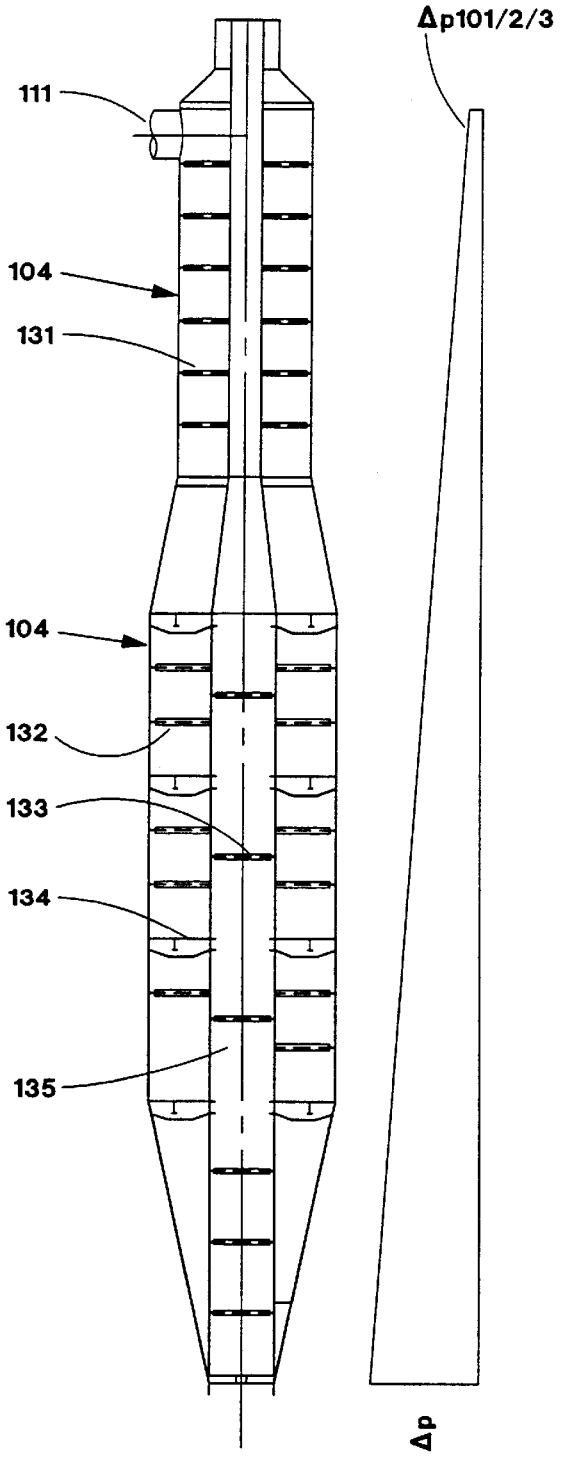
FIGS. 13A and 13B are longitudinal sections through one floatation column.
Figure 13B:
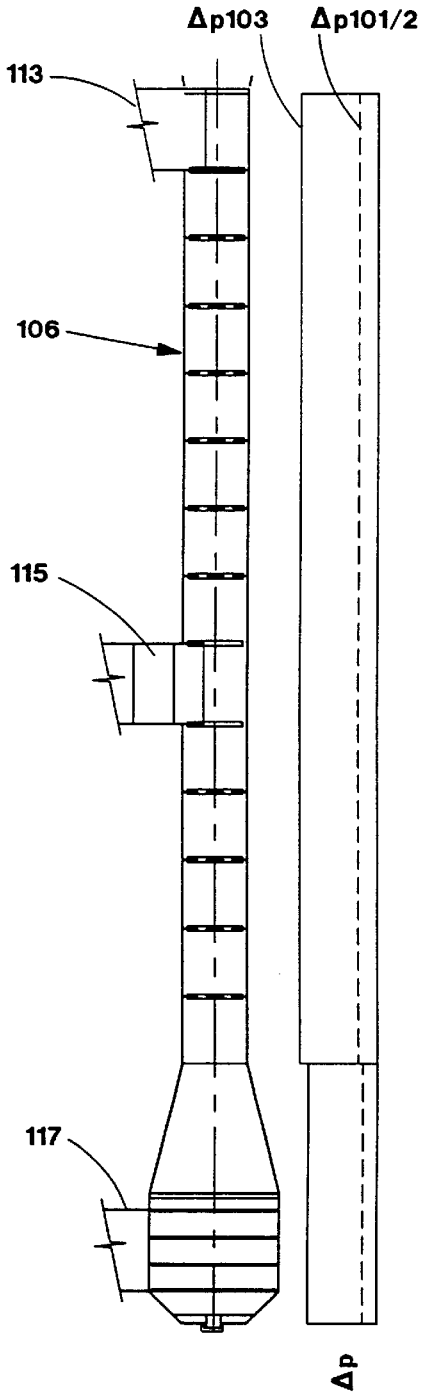

The arrangements for stiffening the interior of the columns are a significant factor in saving steel weight in the completed substructure. Details of internal stiffening for one of the columns are shown in FIGS. 13A and 13B. The surface piercing portion 104 has ring stiffeners 131 fixed to the inner cylindrical surface of the shell. The conical transition is a shell of thicker material. The buoyancy portion 105 has outer shell stiffeners 132 and inner shell stiffeners 133. Water tight bulk heads 134 divide the space between inner and outer shells into watertight compartments. The inner shell defines a central access tube 135. Design of the shells and stiffeners is closely controlled to suit the hydrostatic pressure expected to be experienced by the parts of the columns at that particular depth. Illustrations of the design head $\Delta p$ are shown alongside the sections of the columns. Two types of bulkheads are envisaged for the columns, soft and hard. The hard bulkheads are located at the keel elevation and at the bottom of the buoyancy column.

The main compartmentation used for upending and deck mating operations is contained in the wide bodied portion 105 and the lower transition cone 109 of each column.

Individual compartments are provided with internal and/or external flood and venting valves. External valves, on the lowest compartments, are actuated by a ROV and enable each compartment to be completely flooded individually.

The wide bodied compartments are manifolded within the central access tube 135. The manifold is connected to a high pressure ballast pump which is used to deballast each compartment individually. A separate internal vent line allows the ingress of air into a specific compartment whilst deballasting is in progress. All of these compartments have access manways to allow periodic inspection and/or maintenance as required. The ballast system has twin ballast pumps for redundancy purposes.

The use of three small diameter columns (as compared with a single large diameter hull for a conventional spar) makes the horizontal flats smaller, makes the columns easier to stiffen, and so results in a lighter substructure for the same buoyancy as a conventional spar.

A semi taut mooring system, consisting of six lines in three pairs, restrains the platform on location. This mooring system can best be seen in FIGS. 5 and 29. One particular mooring system is described below. The configuration of the mooring system is highly dependent on water depth and other factors.

Each mooring line consists of a chain-wire-chain combination. A chain segment 141 starts at deck level and passes through fairleaders 142 and 143 on the column. The chain 141 then joins a wire 144. Each mooring line is anchored to the seabed at 146 with a chain segment 145 that connects to the remote end of the wire 144. The wire is a spiral steel strand consisting of class A galvanised wires ranging from 4 to 7 mm diameter resulting in satisfactory breaking strength, tension fatigue, and axial stiffness. The "ordinary rig quality" chain has the same or greater minimum breaking load as the wire. (Synthetic mooring ropes would be lighter in many circumstances.)

The mooring anchorages 146 may consist of the following, depending on bottom soil conditions; drag enbedment anchors, clump weights, or drilled and grouted or suction piles.

Due to the fairly taut catenary mooring arrangement selected, a tight watch circle can be achieved thus reducing loads upon the risers. The mooring lines are attached to the centre of gravity of the hull to minimise the pitch response.

Having described the features of the buoyant substructure, the method of fabrication, loadout, transportation and installation will now be outlined.

Fabrication

Individual column cans are rolled and welded in a workshop. The cans are laid on roller beds and the long seams welded by submerged arc welding. Ring stiffeners are installed with the can in the horizontal or vertical position depending on the fabricator's preference. The ring stiffeners' sizes and locations will be optimised to take advantage of the fabricator/suppliers preferred plate widths. Individual stiffened can sub-assemblies are aligned with each other on the roller beds to assure 'out of roundness' effects are minimised. The cans are then submerged arc welded into larger sub-assemblies and transported to the assembly site.

There are three basic assembly techniques:

Bent Assembly

The substructure is assembled on it's side and parallel to a load out quay. The two 'ground level' columns are positioned adjacent to each other, and interconnecting truss members are installed and welded out to form the first bent. The 'mid-air' column also is assembled adjacent to this bent and the inter-connecting members installed, but only the welds at the 'mid-air' column are completed. This partially completed bent is then lifted and rotated into position using a bank of cranes. Temporary supports are installed to allow the removal of the cranes. The remaining inter-connecting members are then installed and welded out.

Toast Rack Assembly

The substructure is divided into discrete sub-assemblies through the transverse direction, thus the more complex areas (i.e. the inter-connecting members) can be easily fabricated. Depending on the fabricator's facility, each sub-assembly may be completed in it's entirety in the fabrication workshop and moved to the assembly area. This method reduces the volume of 'height' work required at the assembly area and requires fewer crane resources than the bent assembly method.

Jackup Assembly

The columns are assembled and arranged parallel to each other on he ground. The "mid-air" column is erected using jacking towers. Alignment frames would be erected to support the interconnecting members prior to welding out. This method reduces crane requirements and provides dimensional control for assembly of the frame.

Loadout

There are three possible loadout methods:

Lifted

The substructure is assembled adjacent and parallel to the loadout quay. A combination of land-based and two floating shear leg cranes lifts the substructure off it's supports. The cranes 'walk' the substructure to the water's edge and lower it into the water. Depending on the unballasted floating condition, some ballast may be pumped into the substructure to ensure an acceptable floating condition before all the cranes are disconnected.

Sideways Launch

The substructure is assembled adjacent and parallel to the water's edge and is built on slipways. On completion, it is pulled and/or jacked into the water. Suitable ballast is added at the appropriate stage during loadout to assure an acceptable floating and tow condition.

Slipway Launch

The substructure is assembled on the slipway using the Bent or Toast rack method. On completion, it is launched down the slipway.

Transportation

The self floating substructure is transported horizontally on two columns that have a shallow draft. In this position, the longitudinal and transverse stability are excellent. Manoeuvring inshore requires two tugs, and offshore tow uses a single tug. Towing the substructure to site on two legs enables the transit to be made in a stable configuration without large amounts of ballast. Towing in a fully assembled condition avoids the need to connect up discrete lengths of hull in open water (as has been done with conventional spars).

Figure 14:
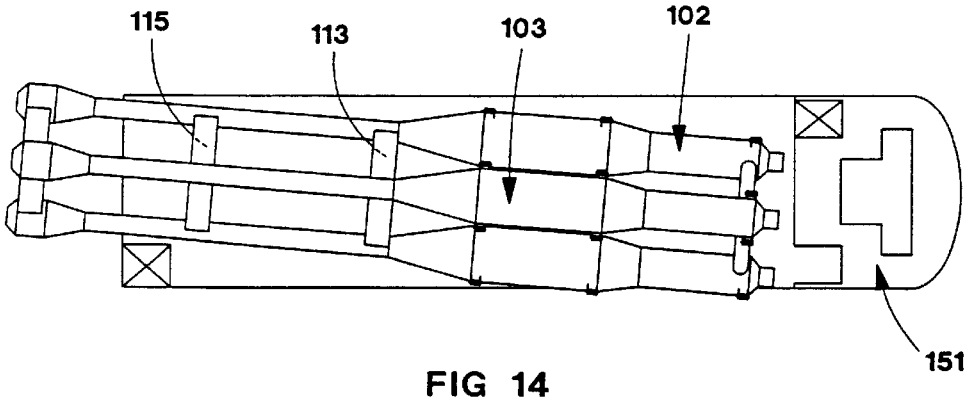
FIG. 14 is a plan of the buoyant substructure (as shown in FIGS. 5 to 13) on a transportation vessel.
Figure 15:
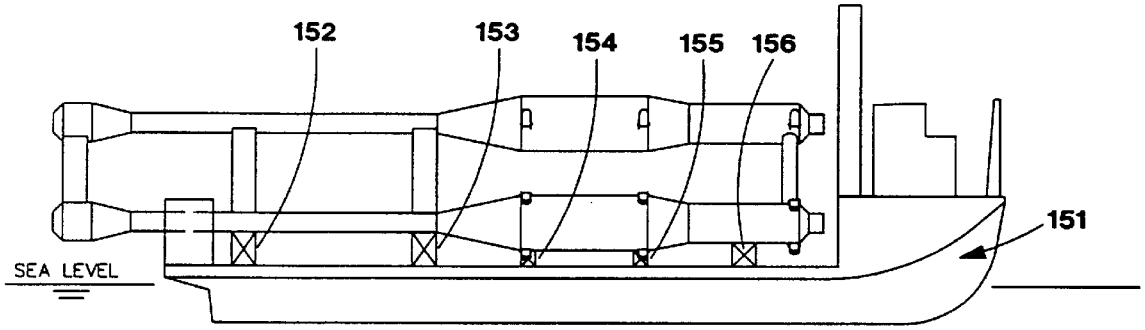
FIG. 15 is a side elevation of the substructure on the vessel.
Figure 16:
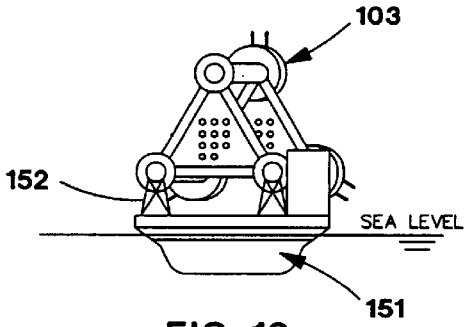
FIG. 16 is an end elevation of the substructure on the vessel.
Figure 17:
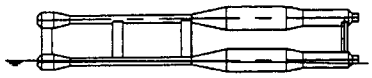
FIGS. 17 to 26 are illustrations of successive stages in an upending/deck installation procedure for the substructure shown in FIGS. 5 to 16.
Figure 18:
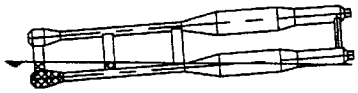
Figure 19:
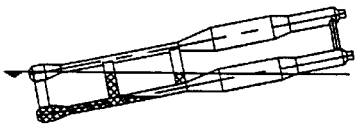
Figure 20:
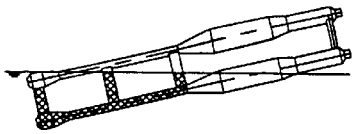
Figure 21:
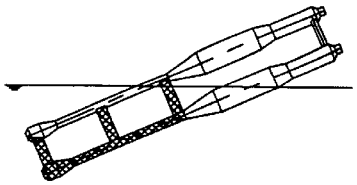
Figure 22:
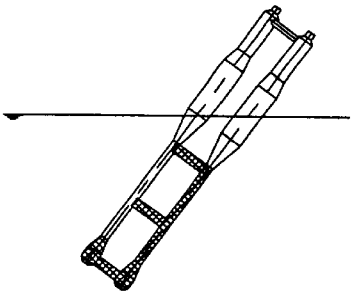
Figure 23:
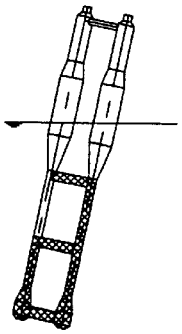
Figure 24:
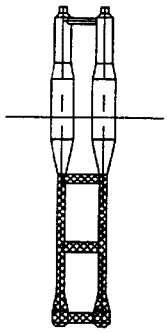
Figure 25:
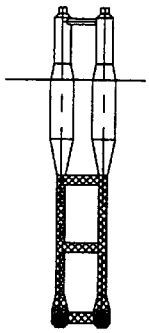
Figure 26:
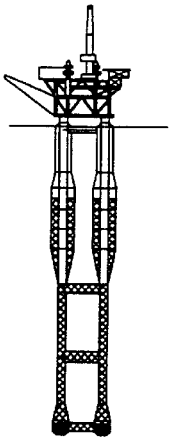

Alternatively the substructure can be transported on a submersible transportation vessel 151, as shown in FIGS. 14–16. The completed substructure is loaded directly onto vessel 151; or can be floated out from its construction site, and then loaded by ballasting and then deballasting the vessel 151 underneath it. Staging 152 to 156 carries the substructure on the vessel. Conveniently staging 152 supports the columns close to box girder 115; staging 153 supports the columns close to box girder 113, and staging 154 and 155 supports the conical ends of column portions 105.

Installation

There are four major installation phases:

Mooring Line Installation

This phase in itself consists of two steps i.e. installation of the seabed anchor and installation of the mooring line respectively.

The seabed anchor may consist of any one of several types, e.g. Bruce or Stevpris anchors, suction and/or drilled and grouted or driven piles, or gravity boxes. Selection of the preferred anchorage is a function of seabed soil conditions, line loads and installation vessel requirements.

To shorten the overall installation programme, it is advantageous to pre-lay the mooring lines. These operations can be performed using two large anchor handling vessels suitably equipped with heavy handling gear and winches. The mooring lines comprise a large diameter wire and chain combination. (Note: It is assumed that the deployment of synthetic mooring ropes will require less robust equipment and possibly fewer vessels, although greater care would have to be exercised throughout the whole handling operation). Depending on the water depth, the mooring line may consist of several components which may have to be joined on the vessel deck. The 'anchor' is lowered from the stern of the vessel and the mooring line is progressively paid out during this process. In some circumstances, the mooring line may be used to lower the anchor thus eliminating the need for a separate lowering system.

As the line is paid out, the remaining components are shackled up. At a pre-determined point, a second vessel may be required to assist in supporting the paid out portion of mooring line if the lowering loads become excessive. This lowering operation continues until the anchor reaches the seabed. The vessels can then move in the laydown direction whilst spooling the mooring line onto the seabed.

Substructure Installation

The substructure is wet towed to the field and is upended. (Alternatively dry transportation may be employed, as shown in FIGS. 14–16.)

The substructure is upended by differential ballasting using controlled flooding of the lower parts of the columns. It will be necessary to pump flood the column 103 which is up in the air. In common with conventional spars, it is expected that initial changes in trim would be very gradual, but that there would then be a rapid rotation to the near vertical. To avoid hydrostatic collapse, all soft tanks must be fully flooded prior to this rotation. The loads on the substructure during upending are quite likely to be the largest in its life. Upending is shown in FIGS. 17–25.

The design head diagram (on FIGS. 13A and 13B) shows that the columns below box girder 113 are governed by the Upending condition. During upending columns 101 and 102 (which are floating on the sea surface prior to upending) are subjected to a relatively low hydrostatic head, while column 103 is subject to a substantially greater hydrostatic head. The controlling design head for the columns above box girder 113 is the float over condition. The internal bulkheads and inner column design heads are governed by the 100 year return damage condition above conical portion 108.

The substructure is temporarily moored, and permanent iron ore ballast is added while it is at low draft. When the substructure is upright and ballasted down to its installation draft, it is then towed to the final location. The taut wire moorings are then retrieved and connected via fairleaders to the mooring points. The mooring lines are tensioned sufficiently to constrain excessive platform movement.

Deck Installation

Figure 27:
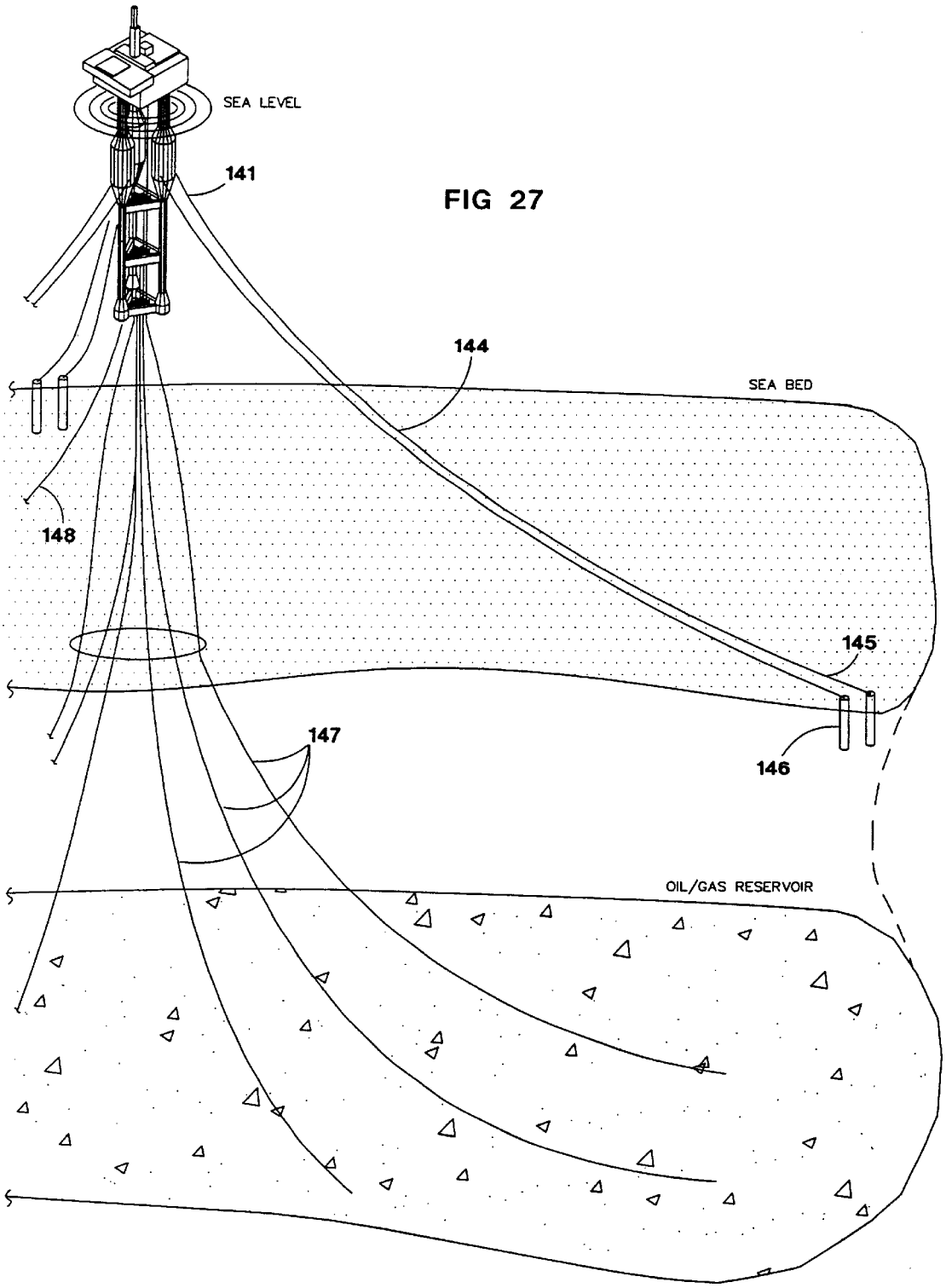
FIG. 27 is an isometric view of the completed platform floating on station in deepwater.

The substructure is further ballasted down to the required deck installation (mating) draft by additional ballasting (FIG. 26) and the mooring lines re-tensioned to compensate for the increase in draft. Floatover or direct lift may be used to place the deck. (Heavier decks will require float over mating.) The deck is brought over the substructure and the mating operation is completed by deballasting the hull thereby decreasing the draft. The deck is integrated with the substructure, so reducing hull steel requirements. When the deck transport is removed, the mooring lines are tensioned to their operational tensions (FIG. 27).

(Alternatively, the substructure may be upended and deck installation may be carried out in sheltered deepwater (e.g. in a fjord), so that the completed platform (substructure and topsides) can be towed to its intended location in a fully assembled condition.)

Riser Installation

The installation of individual well risers 147 is achieved by lowering a riser string down through the interior of the substructure. To ensure the end of the riser passes through the lower inter-connecting truss frames, a messenger line is pre-installed through all riser guides. This messenger line is attached to the riser end. As the riser is lowered, the messenger line is tensioned thus controlling the lateral movement of the end. When the riser is pulled through the lowest guide, the messenger line is disconnected by an ROV. The well riser casing is lowered to the seabed and latched to the seabed wellhead by the ROV. An export riser 148 leads away from the base of the hull.

The substructure is adapted to being used in different water depths, with the same draft but changed displacement. In deeper water (with longer and so heavier risers) less iron ore ballast would be specified.

The substructure is suitable for medium water depths i.e. 120 m to 300 m with flexible well risers. The minimum water depth for rigid well risers is approximately 300 m.

The arrangements shown in FIGS. 28 to 32 control the vertical reaction point of individual mooring lines, thereby adjusting the line of action of the mooring forces.

Figure 28:
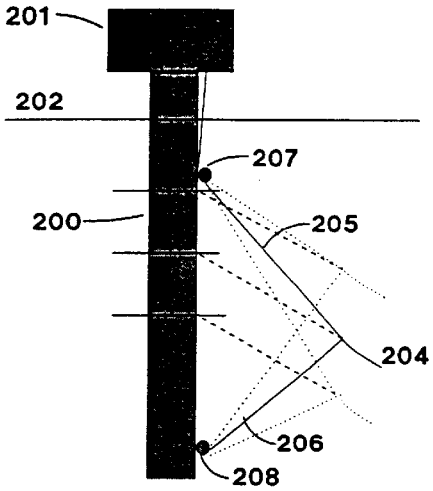
FIGS. 28 to 32 are diagrammatic side views of another buoyant substructure showing a feature of the invention.

FIG. 28 shows the consequence of moving the effective mooring attachment point in a vertical direction. An elongate buoyant substructure 200 has a deck 201, and floats in a stable configuration with respect to a sea surface 202. The substructure has a mooring line 204, attached to the substructure by a bridle 203 having upper and lower elements 205 and 206. Vertically movable fairleaders 207 and 208 connect the bridle 203 to the substructure. (Similar reference numerals will be used in FIGS. 29 to 32.)

Figure 29:
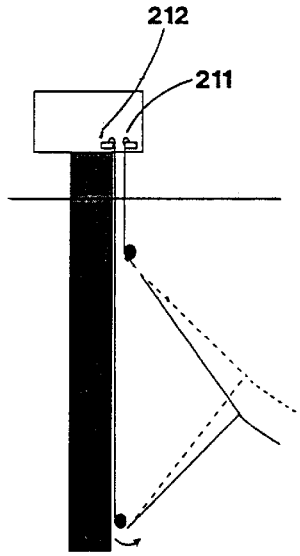

FIG. 29 shows details of one particular arrangement to control the effective vertical attachment point of the mooring line. The main mooring line is attached to a bridle. Each element of the bridle is connected to a fairleader and routed up to a winch (211, 212) located above the sea surface. Each element of the bridle can therefore be controlled individually, and the attachment point for the main mooring line can be shifted in a vertical direction, thereby changing the vertical location of the restoring force produced by the mooring.

Figure 30:
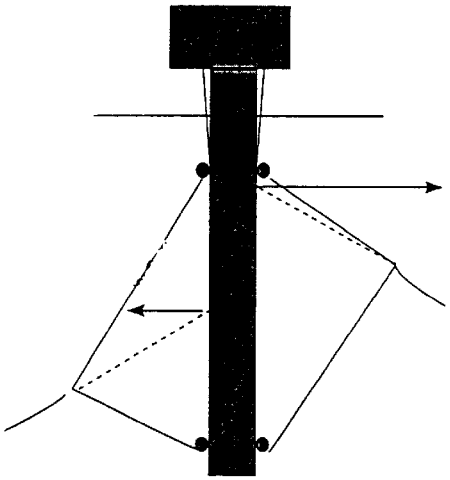

The effect of moving the vertical attachment point on opposite mooring lines is illustrated in FIG. 30. The mooring lines can be adjusted to create a couple which is equal and opposite to the wind overturning moment, although both lines are attached well below the level at which the wind load is applied. Moments introduced due to weight changes/shifts in deck loads can also be corrected for by adjusting the effective vertical attachment point of opposite lines until an equal and opposite moment is produced.

Figure 31:
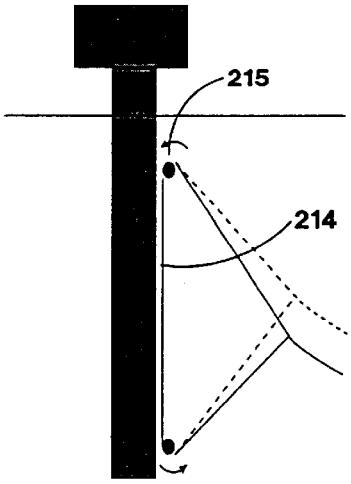
Figure 32:
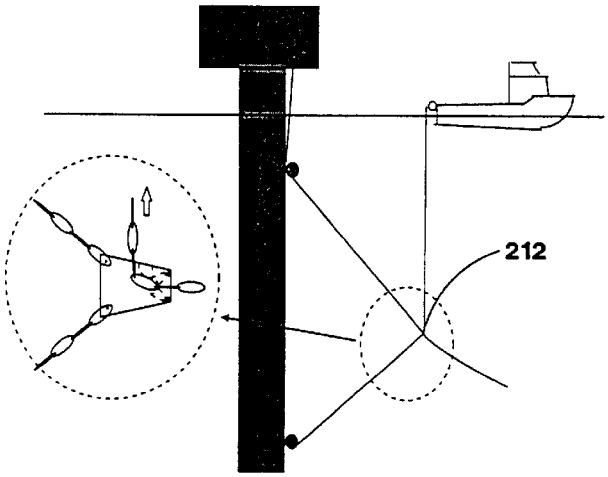

An alternative to routing both bridle lines up to the deck is to use a continuous loop 214 between two fairleaders as illustrated in FIG. 31. One of the fairleaders is powered (for instance with electrical or hydraulic power 215) such that part of the closed loop is moved up or down thereby shifting the attachment point for the main mooring line in the vertical direction.

One area of interest for the bridle and continuous loop arrangement (in FIG. 31) is the hook-up of the main mooring line to the bridle/continuous loop. Part of the system is the chain stopper 216 arrangement illustrated in FIG. 32. The main mooring line consists of a chain section at the top end. This chain is pulled through a ratchet type chain stopper attached to the bridle or continuous loop to for instance a work boat on the surface. Once the correct pretension is set, the excess chain can be cut by diver or remote operated vehicle.

Advantages of the Invention

In summary the buoyant substructure described above shows the following advantageous features:

- Dry wellheads, thus minimising subsea activities
- Compatible with flexible or rigid risers, dependent on water depth
- Rigid export risers possible in deepwater for particularly aggressive fluids
- Well workover from platform deck
- Significant steel weight savings
- Minimum extreme storm condition motion response
- Easy fabrication, loadout, transport, installation and maintenance

What is claimed is:

1. A buoyant substructure to float upright in water to form part of a permanently moored floating offshore platform, comprising:

at least three spaced apart columns joined together in generally aligned relationship, the arrangement of the columns being such that when floating upright the columns have upper and lower ends;

in which at least one of the columns (103) has a ballastable compartment (107) at its lower end which is adapted to be ballasted with solid material, in which the columns arc joined together by cross members (111, 113) which are widely spaced apart along the length of the columns;

mooring fairleaders (143), wherein the mooring fairleaders are disposed on the columns, and in which the dimensions of the cross members (111, 113) in the direction of alignment of the columns are small as compared with the total length of the columns.

2. A substructure as claimed in claim 1, in which the solid material is composed of removable particulate material.

3. A substructure as claimed in claim 2 when ballasted with removable particulate material.

4. A substructure as claimed in claim 1, in which at least the column having a ballastable compartment at its lower end has at least two cylindrical portions, one of which portions is above and the other of which portions is below at least one of the cross members.

5. A substructure as claimed in claim 1, in which at least the column having a ballastable compartment at its lower end has a surface piercing portion, a buoyancy portion, and a ballastable portion, in which (when floating upright) the horizontal cross section of the buoyancy portion is greater than the horizontal cross section of the ballastable portion, and in which the buoyancy portion and the ballastable portion are joined by a tapering transition portion.

6. A substructure as claimed in claim 5 in which all of the at least three columns have generally aligned surface piercing portions, buoyancy portions and ballastable portions.

7. A substructure as claimed in claim 6 in which all of the columns are of identical external configuration.

8. A substructure as claimed in claim 6, in which (when floating upright) two of the columns have identical respective horizontal cross sections along their aligned lengths.

9. A substructure as claimed in claim 5 in which at least one of the cross members is located close to bases of the ballastable portions.

10. A substructure as claimed in claim 5 in which the external surfaces of the buoyant portions are uninterrupted by the cross members.

11. A substructure as claimed in claim 5, in which (when floating upright) the horizontal cross section of the buoyancy portion is greater than the horizontal cross section of the surface piercing portion.

12. A substructure as claimed in claim 11 in which the at least three columns are joined together in spaced apart relationship between the surface piercing portions, and at or near the respective opposed ends of the ballastable portions.

13. A substructure as claimed in claim 1, in which the columns are aligned in parallel relationship.

14. A substructure as claimed in claim 1, in which at least three columns are joined together in spaced apart relationship at three positions along their aligned lenths.

15. A substructure as claimed in claim 1, in which the columns are joined by cross members comprising lattice truss frameworks in planes defined by adjacent columns.

16. A substructure as claimed in claim 1 in which the columns are joined by cross members comprising box girders in planes defined by adjacent columns.

17. A substructure as claimed in claim 1, in which elements joining the columns together in spaced apart relationship constitute riser and/or conductor guides.

18. A substructure as claimed in claim 1, in which elements joining the columns together in spaced apart relationship constitute heave suppression baffles.

19. A substructure as claimed in claim 1, in which a mooring line to keep the substructure on station is connected to the substructure by a bridle having upper and lower elements which can be controlled to adjust the line of action of the force in the mooring line.

20. A substructure as claimed in any one of claims 2 to 19, when ballasted with removable particulate material.

21. A method of forming a buoyant substructure to form part of a permanently moored floating offshore platform, which includes the steps of constructing at least three columns horizontally for joining in a spaced apart relationship, floating the substructure so formed horizontally on two of those columns, uprighting the substructure by selective ballasting with water, adding solid ballast to the lower end of at least one of the columns, and securing the substructure in position with mooring lines.

* * * * *